United States Patent [19]

Kurata et al.

[11] 4,412,850

[45] Nov. 1, 1983

[54] ELECTRIC DUST COLLECTOR

[75] Inventors: Tonio Kurata, Yokohama; Hiroshi Fuji, Machida, both of Japan

[73] Assignee: Neat Shujinki Kogyo Kabushiki Kaisha, Yokohama, Japan

[21] Appl. No.: 397,162

[22] Filed: Jul. 12, 1982

[30] Foreign Application Priority Data

Jul. 11, 1981 [JP] Japan ..... 56-108515

[51] Int. Cl.[3] ..... B03C 3/36; B03C 3/40

[52] U.S. Cl. ..... 55/130; 55/137; 55/152; 55/154

[58] Field of Search ..... 55/130, 137, 152, 156, 55/154

[56] References Cited

U.S. PATENT DOCUMENTS

| | | | |
|---|---|---|---|
| 1,333,790 | 3/1920 | Bradley | 55/152 X |
| 2,199,390 | 5/1940 | Anderson | 55/137 X |
| 2,383,030 | 8/1945 | White | 55/130 |
| 3,650,092 | 3/1972 | Gourdine et al. | 55/145 X |
| 3,759,014 | 9/1973 | Van Dyken et al. | 55/130 X |
| 4,126,434 | 11/1978 | Keiichi | 55/137 |

FOREIGN PATENT DOCUMENTS

| | | | |
|---|---|---|---|
| 694923 | 9/1964 | Canada | 55/152 |
| 747301 | 4/1956 | United Kingdom | 55/154 |
| 966558 | 8/1964 | United Kingdom | 55/130 |
| 999051 | 7/1965 | United Kingdom | 55/152 |

*Primary Examiner*—Kathleen J. Prunner

*Attorney, Agent, or Firm*—George B. Oujevolk

[57] ABSTRACT

An electric dust collector is provided. A discharge unit consists of an array of a plurality of discharge electrodes each having a plurality of discharge styluses attached to each inner or outer side of a member of a light gauge steel for general structure to be parallel to a gas flow direction. An oppositely charged particle collecting unit consists of an array of a plurality of members of light gauge steel for general structure as dust collecting electrodes and is located downstream from the discharge unit in the gas flow direction. The discharge unit and the oppositely charged particle collecting unit are alternately arranged to constitute a discharge electrode side. A dust collecting unit consisting of an array of members of light gauge steel for general structure as dust collecting electrodes are arranged at predetermined intervals at each side of the discharge electrode side. Lines normal to and depending from pointed ends of the discharge electrodes substantially coincide with central lines of side surfaces of the dust collecting electrodes of the dust collecting unit.

1 Claim, 8 Drawing Figures

ELECTRIC DUST COLLECTOR

BACKGROUND OF THE INVENTION

1. Field of the Invention

The present invention relates to an electric dust collector for electrically collecting and removing solids and other particles floating in a gas and, more particularly, to an economical electric dust collector which has a high and stable dust collecting efficiency and which is compact in size and light in weight.

2. Description of the Prior Art

A typical conventional duct-type electric dust collector is subject to many technical problems. For example, the total surface area of the electrodes is small and, therefore, the dust collecting area per unit volume is small. The dust collecting efficiency for the effective volume of the collector is low. The overall collector is large in size and is heavy in weight. The installation cost for the related equipment around the casing of the collector is high. Furthermore, hammering must be periodically performed to remove the dust deposited on the discharge electrodes, so that the problem of core enlargement may be prevented.

SUMMARY OF THE INVENTION

It is an object of the present invention to provide an electric dust collector which is compact in size by reducing the effective volume of a dust collecting unit with split dust collecting electrodes.

It is another object of the present invention to provide an electric dust collector which also has a collision-type mechanical dust collecting function in accordance with the shapes, combination and arrangement of the electrodes.

It is still another object of the present invention to provide an electric dust collector which has rectifying function of a gas flow and which prevents mechanical rescattering of dust by hammering or the like of collected dust.

It is still another object of the present invention to provide an electric dust collector which adopts an electrode structure which adopts pointed discharge electrodes for improving the charging efficiency without considering the mechanical strength or the like and which includes a discharge electrode side dust collecting area of oppositely-charged particles, so that power consumption of charging equipment is reduced and the oppositely-charged particles are treated, thereby eliminating a need for continuous hammering of the discharge electrodes.

It is still another object of the present invention to provide an electric dust collector which is improved in the electrostatic rescattering prevention effects to obtain the self-cleaning effect and which is economical and is excellent in the charging efficiency and dust collection capacity.

DETAILED DESCRIPTION OF THE PREFERRED EMBODIMENTS

Figure 1:
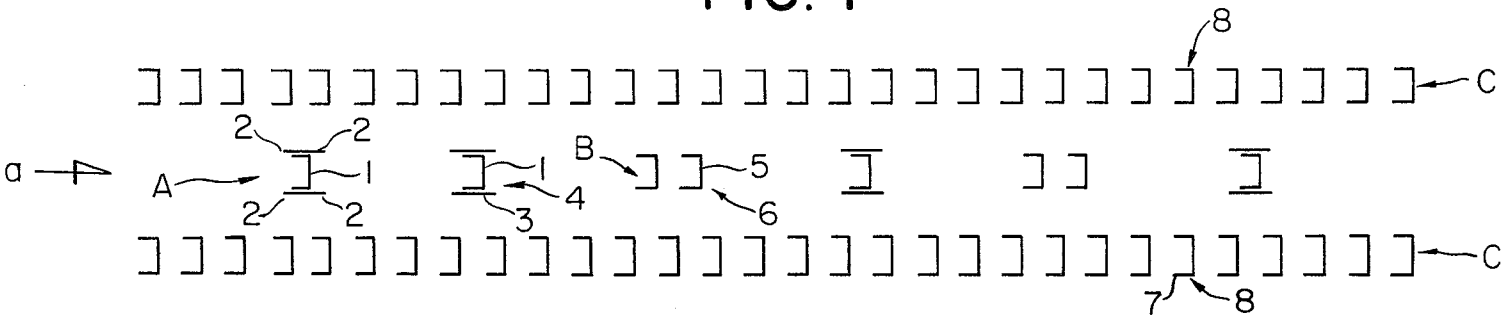
FIG. 1 is a schematic plan view showing the arrangement according to the first embodiment of the present invention.
Figure 3:
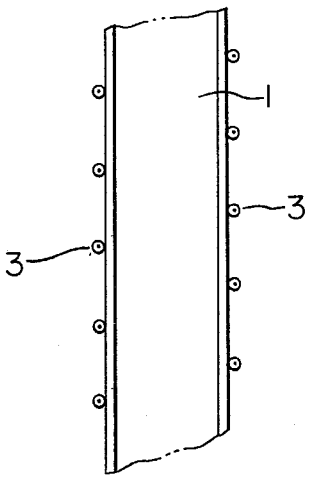
FIGS. 3(*a*) and 3(*b*) are side views of the discharge electrode as viewed in the direction of gas flow.
Figure 3:
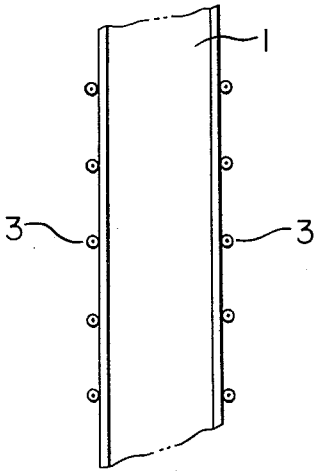
Figure 2:
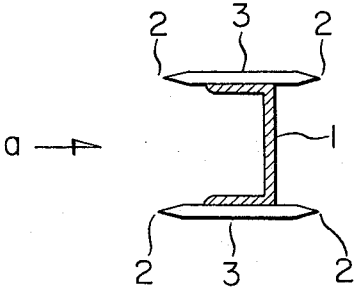
FIG. 2 is an enlarged plan view of the discharge electrode of the embodiment shown in FIG. 1.

The present invention will now be described in more detail with reference to the accompanying drawings. FIGS. 1 to 3 show the first embodiment. A plurality of discharge styluses 3 each having pointed ends 2 are attached at equal intervals to each outer side of a light gauge steel for general structure or light gauge groove shape steel member 1 to be parallel to a gas flow direction a, thus forming a discharge electrode 4. A plurality of discharge electrodes 4 are arranged at predetermined intervals to form a discharge unit A. A plurality of members 5 of light gauge steel for general structure or light gauge groove shape steel as dust collecting electrodes 6 are arranged at predetermined intervals to form an oppositely charged particle collecting unit B downstream from the discharge unit A in the gas flow direction. The discharge units A and the collecting units B are alternately arranged in an array such that their steel members are perpenducular to the gas flow direction a, thus defining the discharge electrode side. A plurality of members 7 of light gauge steel for general structure or light gauge groove shape steel as dust collecting electrodes 8 are arranged at the same intervals as that of the collecting units B at each side of the array of the discharge units A and the collecting units B. A dust collecting unit C is thus formed. The positions of the pointed ends 2 of the discharge stylus 3 are defined such that a line normal to and depending from each pointed end 2 passes through the substantially central line of the opposing side surface of the steel member 7 of the dust collecting electrode 8. The discharge styluses 3 on both sides of the steel member 1 may be arranged at the same pitch or levels, or those on one side may be deviated by half the pitch from those on the other side, as seen in FIGS. 3(*a*) and 3(*b*).

The oppositely charged particle collecting unit B may comprise a combination of lip shape steel and hat shape steel members.

Figure 4:
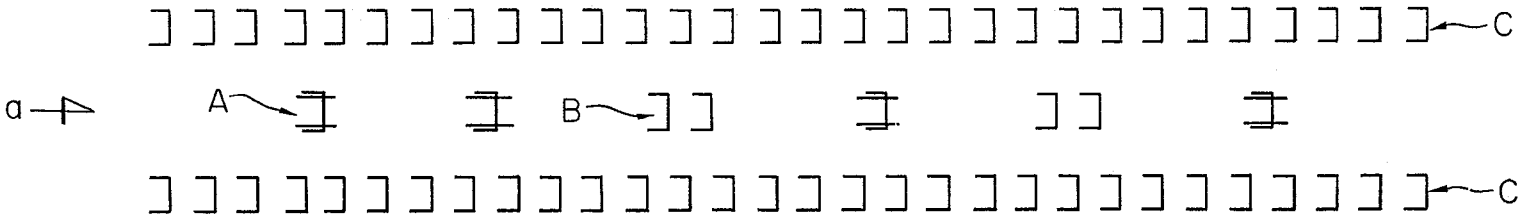
FIG. 4 is a schematic plan view showing the configuration of the second embodiment.
Figure 5:
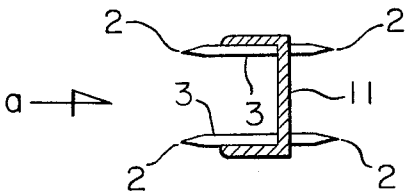
FIG. 5 is an enlarged plan view of the discharge electrode of the embodiment shown in FIG. 4.

FIGS. 4 and 5 show the second embodiment of the present invention. A plurality of discharge styluses 3 each having pointed ends 2 are attached at equal intervals to each inner side of a compact and light weight type steel member 11 through bores formed therein, thus forming a discharge electrode 4. The discharge styluses 3 are parallel to the gas flow direction a. A plurality of discharge electrodes 4 are arranged at predetermined intervals to form a discharge unit A. A plurality of members 5 of steel for general structure or light gauge groove shape steel as dust collecting electrodes 6 are arranged at predetermined intervals to form an oppositely charged particle collecting unit B downstream from the discharge unit A in the gas flow direction a. The configuration of the oppositely charged particle collecting unit B remains the same as that of the first embodiment. More specifically, a plurality of members 7 of light gauge groove shape steel as dust collecting electrodes 8 are arranged at predetermined intervals at each side of the array of the discharge units A and the dust collecting units B. The pointed ends 2 and the dust collecting electrodes 8 of the dust collecting unit C hold the same relationship as described with reference to the first embodiment.

Figure 6:
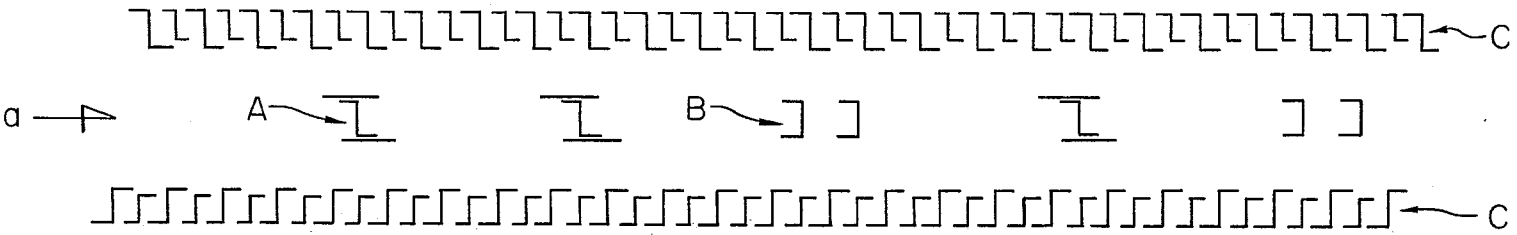
FIG. 6 is schematic plan view showing the configuration of the third embodiment of the present invention.
Figure 7:
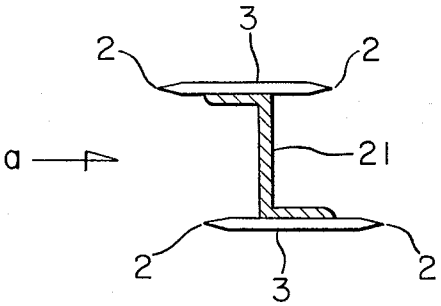
FIG. 7 is an enlarged plan view of the discharge electrode of the embodiment shown in FIG. 6.

FIGS. 6 and 7 show the third embodiment of the present invention. In this embodiment, members of Z shape steel among steel for general structure are used for the discharge electrodes 4 of the discharge unit and for the dust collecting electrodes 8 of the dust collecting unit. A plurality of discharge styluses 3 each with pointed ends 2 are attached at predetermined intervals on each outer side of a Z shape steel member 21 to be parallel to the gas flow direction a to form the discharge electrode 4. The configurations and arrangements of the discharge unit A, the oppositely charged particle unit B and the dust collecting unit C remain the same as those in the first and second embodiments except that Z shape steel members of the same shape as that of the dust collecting electrodes 8 are interposed between each pair of adjacent dust collecting electrodes 8.

If the shape steels of the same or different shapes as that of the dust collecting electrodes 8 are interposed between each pair of adjacent dust collecting electrodes 8 of the dust collecting unit C in the first or second embodiment, the dust collecting area is increased and the dust collection efficiency is improved.

In the embodiments described above, the upper ends of the discharge units A, the oppositely charged particle collecting units B and the dust collecting unit C are suspended from a suitable beam (not shown), and the lower ends thereof are fitted to be supported on support rods (not shown). Since there are many other types of steels for general structure than those used in the embodiments described above, they may be suitably selected and/or combined.

The mode of operation of the collectors of the embodiments described above will now be described. When a high voltage is applied to the discharge electrode 4, corona discharge occurs between the pointed ends 2 of the discharge styluses 3 and the dust collecting electrodes 8. The dust particles in the gas are charged to be attracted to the dust collecting electrodes 8, while oppositely charged dust particles are attracted to or trapped by the surfaces of the discharge electrode 4 and the dust collecting electrode 6 of the oppositely charged particle collecting unit B at the discharge electrode side. Non-attracted or non-trapped particles are charged by passing through the gap between the adjacent collecting electrodes 8 or by the corona discharge from the adjacent duct.

All the dust collecting electrodes 6 of the dust collecting unit B function as a rectifying device of the gas flow. Moreover, corona wind of the discharge styluses 3 facilitates dispersion of the gas and deflection of the charged dust particles. The dust deposited on the electrodes is removed by hammering or by slipping by its own weight.

According to the present invention, all the electrode members are made of a steel for general structure for ruggedness. Owing to their arrangement and combination, the total surface area of the electrodes is about twice to three times that of a typical conventional duct-type electric dust collector. Thus, the dust collecting area per unit volume is very wide and the dust collection efficiency for the same effective volume is high, thus allowing a significant decrease in the effective volume of the dust collecting unit and providing a compact and high weight collector. The cost of shells of the collector such as a casing and other related equipment and facilities such as accessories, a base, a dust exhaust mechanism, foundation, heat-insulting facility, painting may be significantly reduced.

Due to the shape, arrangement and combination of the member of steel for general structuere, it has a collision-type mechanical dust collecting function. Therefore, the electric dust collector of the present invention has a higher dust collection efficiency than conventional electric dust collectors due to its electric dust collecting function and mechanical dust collecting function. Since the collector also has a gas rectifying function, a conventional rectifying plate or other rectifying means may be simplified. Since partition by the dust collecting plate is not provided, any directionality is not given to the gas flow; the gas flows freely and is subjected to more chances of dispersion and charging of dust. Since corona discharge occurs through a minimum distance between the pointed ends of the electrodes and the substantial centers of the side surfaces of the dust collecting electrodes, the corona start voltage is low, the electric field intensity near the electrodes is increased, and the dust collection efficiency is good. The voltage to be applied may also be lowered, resulting in less power consumption to contribute to energy conservation. Since the strong corona wind is generated of styluses which are pointed with high precision, the self-cleaning effect of the discharge electrodes to prevent the deposition of dust on the pointed ends is improved. Therefore, continuous hammering of the conventional collector is not required. By combining the oppositely charged particle collecting electrodes with the discharge electrodes, problems of conventional collectors such as the core enlargement and electrostatic rescattering due to extremely-high or -low electric inherent resistance dust may be prevented.

Due to attraction between the particles, the dust particles deposited on the electrodes gather to form larger particles which are separated from the electrodes by hammering or their own weights, thus mechanically preventing rescattering.

The collector of the present invention has a high stable dust collection efficiency and is economical due to its construction and function.

We claim:

1. An electric dust collector which includes a discharge unit comprising an array of a plurality of discharge electrodes each having a plurality of discharge styluses attached to each inner or outer side of a member of a light gauge steel for general structure to be parallel to a gas flow direction, an oppositely charged particle collecting unit comprising an array of a plurality of members of light gauge steel for general structure as dust collecting electrodes located downstream from said discharge unit in the gas flow direction, said discharge unit and said oppositely charged particle collecting unit being alternately arranged to constitute a discharge electrode side, a dust collecting unit consisting of an array of members of light gauge steel for general structure as dust collecting electrodes arranged at predetermined intervals at each side of said discharge electrode side, lines normal to and depending from pointed ends of said discharge electrodes substantially coinciding with central lines of side surfaces of said dust collecting electrodes of said dust collecting unit.

* * * * *